US008051797B1

(12) United States Patent
Teichman et al.

(10) Patent No.: US 8,051,797 B1
(45) Date of Patent: Nov. 8, 2011

(54) DEVICE TO STABILIZE AND ALIGN A PRE-MOUNTED STENT

(75) Inventors: Eyal Teichman, Hod-Hasharon (IL); Dymphna Donaghy, Glencar (IE); Gareth Walsh, Galway (IE)

(73) Assignee: Boston Scientific Scimed, Inc., Maple Grove, MN (US)

( * ) Notice: Subject to any disclaimer, the term of this patent is extended or adjusted under 35 U.S.C. 154(b) by 1707 days.

(21) Appl. No.: 11/268,176

(22) Filed: Nov. 7, 2005

(51) Int. Cl.
*B05C 13/00* (2006.01)
*B05D 3/00* (2006.01)

(52) U.S. Cl. ..... 118/500; 427/2.1

(58) Field of Classification Search ..... 623/1.1, 623/192, 198, 108, 194; 118/500; 427/2.1
See application file for complete search history.

(56) References Cited

U.S. PATENT DOCUMENTS

| | | | | | |
|---|---|---|---|---|---|
| 943,202 | A * | 12/1909 | Struss | 206/389 |
| 3,582,526 | A * | 6/1971 | Campana | 204/213 |
| 3,813,904 | A * | 6/1974 | Wallskog | 70/169 |
| 5,476,454 | A * | 12/1995 | Campbell | 604/533 |
| 5,626,604 | A * | 5/1997 | Cottone, Jr. | 606/198 |
| 5,785,715 | A * | 7/1998 | Schatz | 606/108 |
| 5,931,851 | A * | 8/1999 | Morales | 606/194 |
| 5,972,028 | A * | 10/1999 | Rabenau et al. | 623/1.11 |
| 6,203,551 | B1 * | 3/2001 | Wu | 606/108 |
| 6,267,754 | B1 * | 7/2001 | Peters | 604/533 |
| 6,645,547 | B1 | 11/2003 | Shekalim et al. | |
| 7,594,926 | B2 * | 9/2009 | Linder et al. | 623/1.11 |
| 7,651,529 | B2 * | 1/2010 | Gellman et al. | 623/23.66 |
| 2001/0010006 | A1 * | 7/2001 | Bachinski et al. | 606/153 |
| 2002/0157981 | A1 * | 10/2002 | Whiting et al. | 206/438 |
| 2007/0193905 | A1 * | 8/2007 | Jemelin et al. | 206/438 |
| 2008/0197102 | A1 * | 8/2008 | Farrar et al. | 215/335 |

* cited by examiner

*Primary Examiner* — Dah-Wei Yuan
*Assistant Examiner* — Charles Capozzi
(74) *Attorney, Agent, or Firm* — Vidas, Arrett & Steinkraus

(57) ABSTRACT

A support device is provided to hold a pre-mounted device, such as a stent mounted on a balloon of a delivery catheter, for insertion in a coating apparatus. The support device stabilizes, aligns and holds the pre-mounted stent assembly in order to allow correct location and rotation in relation to a coating applicator in a coating apparatus and to avoid damage during the coating process.

11 Claims, 10 Drawing Sheets

DEVICE TO STABILIZE AND ALIGN A PRE-MOUNTED STENT

FIELD OF THE INVENTION

The present invention is directed toward a device to stabilize, align and hold a prosthesis, e.g., a stent, that is pre-mounted on a catheter in order to allow correct location and rotation of the pre-mounted stent in relation to a coating applicator in a coating machine and to avoid damage of the coated stent during the coating process.

BACKGROUND OF THE INVENTION

The benefits of delivering drug-loaded prostheses to patients are becoming well known. Studies have shown the importance of delivering the correct drug dose density on coronary stents to prevent restenosis by application of drugs such as paclitaxel or rapamycin. Numerous processes have been proposed for the application of such a coating including: soaking or dipping the implantable device in a bath of liquid medication, soaking in an agitated bath, introducing heat and/or ultrasonic energy in conjunction with a medicated bath, and spraying the medication by way of pressurized nozzles.

Initially, such coatings were applied at the time of manufacture of the medical device. For various reasons, including the relatively short shelf life of some drugs compared to the time span from manufacture to implantation, a need has arisen for technologies that permit applying a coating to a medical device just prior to implantation of the device sometimes referred to as application at the "point of care." Just in time delivery of properly dosed devices would address the shelf-life limitations of various medicinal coatings as well as provide custom treatment.

Many of the methods and devices intended to coat a device just prior to implantation, however, deposit the coating material onto any and all surfaces that are exposed to the coating. This may result in depositing coating material on surfaces for which the coating is unwanted or undesirable. Further, the coating may crack or break away when the implantable device is removed from the implantation apparatus. An example of this would be a stent deployed on a catheter balloon. As the balloon is inflated, and the stent is expanded into position, the coating may crack along the interface between the stent and the balloon. These cracks may lead to a breaking away of a portion of the coating from the stent itself. Similar problems can occur in cases where the coating technique fails to prevent inadvertent overlapping with the edges, i.e., the internal surfaces along the edges of various devices, e.g., struts of stents. This, in turn, may affect the medicinal effectiveness of the coating, and negatively affect the entire medical procedure.

It is known to use ink-jet technology to apply a liquid to selected portions of a surface. An ink-jet nozzle moves in three dimensions with respect to the device to be coated with the aid of a motion control system. The motion control system enables the ink-jet nozzle to move over the portions of the prosthesis to be coated. Alternatively, a real-time picture can be taken with a camera to determine the position of the ink-jet nozzle in relation to the prosthesis. Based upon the feedback of nozzle location, the ink-jet applicator can be controlled by activating the spray, moving the ink-jet nozzle, and/or moving the prosthesis to adjust to the pattern to better conform with the actual prosthesis.

For systems where the motion is preprogrammed, selected patterns may fail to accommodate inherent variability in the surface of the prosthesis. In one non-limiting embodiment, for example, a stent crimped around a balloon catheter will not be crimped the same as a next crimped stent such that successive crimped stents present the same surface each time. The crimping cannot be determined from the factory according to the manufacturer's specifications of the stent.

SUMMARY OF THE INVENTION

Coating a stent already mounted on a balloon catheter provides for customized treatment and, possibly, better long term results. Further, with one embodiment of the present invention, a bare stent with desirable mechanical properties can be coated with almost any medicinal compound. The present invention provides an interface to a coating apparatus such that either an un-mounted or a pre-mounted stent can be coated because the apparatus provides for stable placement. The device, in one embodiment, allows an "on catheter stent system" to be accurately coupled, i.e., mounted, in substantially the center of a rotating system without damaging the catheter stent system and while preventing the catheter stent system from becoming contaminated. With the present invention, a physician may coat a bare stent, i.e., one that does not ordinarily come with a coating, with a specific coating. The present system is applicable in both a "point of care" situation and an industrial, or high volume, environment where devices are coated in mass quantities.

In one embodiment, a device comprises: a substantially cylindrical housing having a longitudinal length and having proximal and distal ends; a first bushing coupled to the distal end of the housing; a guidewire partially inserted through the housing, the guidewire having a proximal end and a distal end, wherein the proximal end of the guidewire remains free and is not located within the housing; and a second bushing attached to the distal end of the guidewire.

The device may further comprise a cover comprising proximal and distal portions coupled, respectively, to the first and second bushings. The cover may be releasably coupled to the first and second bushings.

The cover may comprises a first spring flap to couple the cover to the first bushing; and a second spring flap to couple the cover to the second bushing.

A knob is slideably disposed about the proximal end of the housing and configured to slide a predetermined distance along an outer surface of the housing; a guide pipe, is coupled to the knob, and is disposed within the housing, wherein the guidewire passes through the guide pipe; and a locking guide is disposed within the housing and has an opening through which the guidewire passes, wherein the guide pipe extends through the locking guide when the knob is moved toward the distal end of the housing.

The locking guide comprises: a plurality of guide portions sized to fit within the housing; and each guide portion having an opening sized to receive and hold a catheter portion, wherein each guide portion comprises a material having resilient properties.

The opening in the locking guide expands from a first diameter to a second diameter by operation of the guide pipe when the knob is moved toward the distal end of the housing and returns to substantially the first diameter when the knob is returned to the proximal end of the housing and the guide pipe is withdrawn from the opening of the locking guide.

In another embodiment, a system for positioning a prosthesis in a coating apparatus comprises: a stabilizing device configured to hold the prosthesis in a defined orientation with respect to the coating apparatus, the stabilizing device comprising: a substantially hollow housing having a longitudinal length extending between a proximal end and a distal end; a first coupling mechanism disposed at the distal end of the housing; a second coupling mechanism; and a removable cover, having proximal and distal ends, coupled, respectively, to the first and second coupling mechanisms.

The cover further comprises: a first spring flap to couple the proximal portion of the cover to the first coupling mechanism; and a second spring flap to couple the distal portion of the cover to the second coupling mechanism.

The system further comprises: a guide pipe disposed within the housing; a knob, coupled to the guide pipe, and slideably disposed about the proximal end of the housing; and a resilient guide disposed within the housing, the resilient guide having an opening through which the guidewire passes, wherein the guide pipe extends through the resilient guide when the knob is moved toward the distal end of the housing, and wherein the guidewire passes through the guide pipe.

BRIEF DESCRIPTION OF THE DRAWINGS

The above and further advantages of the invention may be better understood by referring to the following description in conjunction with the accompanying drawings in which.

DETAILED DESCRIPTION

Figure 1:
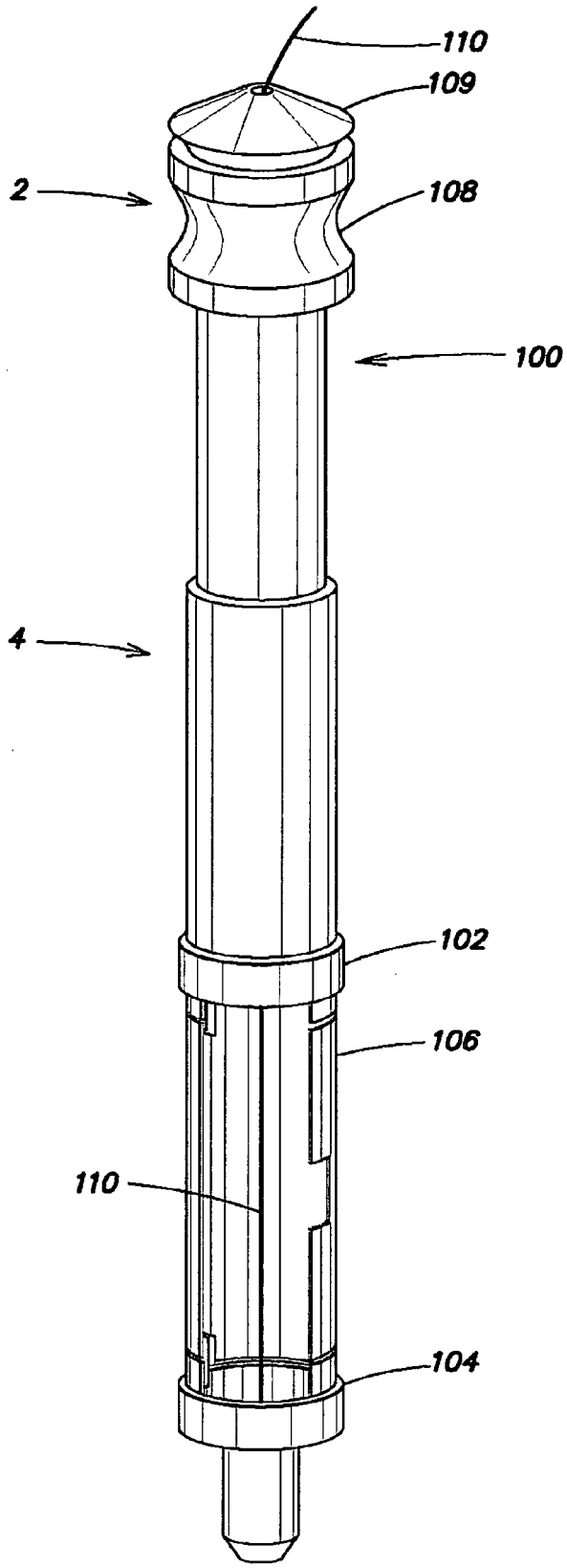
FIG. 1 is a schematic drawing of a stabilizing device in accordance with one embodiment of the present invention.

Currently, only a small number of stents are available with medicinal coatings and the coatings are limited to a relatively small number of different medicines. The coating dosages, because the stents are mass produced, may also arrive only in particular ranges. The limited number of stents with coatings and the respective mechanical attributes combined with the limited number of dosages may present a physician with making a choice that compromises on one aspect of treatment or another.

With a "just-in-time" coating applicator, a physician may coat a device with a specific coating formulation for a particular patient. Such a coating machine may be one as described in U.S. Pat. No. 6,645,547 to Shekalim, et al. titled "Stent Coating Device" and issued on Nov. 11, 2003, the subject matter of which is incorporated herein in its entirety. Further, a physician may choose among many different bare stents or devices and turn one into a coated device. As a non-limiting example, a physician may have had good results with a particular bare stent and desire to coat it with a medicinal coating. If there is not a coated version of the stent, the physician may place it in the coating apparatus and apply the coating.

Stents often are sold already mounted on a delivery system. Coating a pre-mounted stent, without coating the balloon, requires as system that can discern the stent from the balloon. Further, the mounted stent must be held to receive the coating.

A system that provides a stable and accurate support structure for a pre-mounted medical device, for example, a stent mounted on a balloon catheter will be described.

The invention is herein described, by way of example only, with reference to the accompanying drawings. It is stressed that the particulars shown are by way of example and for purposes of illustrative discussion of the various embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Prior to explaining at least one embodiment of the present invention in detail, it is to be understood that the invention is not limited in its application to the details of construction and the arrangement of the components set forth in the following description or illustrated in the drawings. The invention is capable of other embodiments or of being practiced or carried out in various ways. For example, the present invention is applicable in either a point of care or industrial environment and any reference to the former or the latter, with respect to the device, is for explanatory purposes only and does not limit the invention except as otherwise claimed. Also, it is to be understood that the phraseology and terminology employed herein are for the purpose of description and should not be regarded as limiting.

It is appreciated that certain features of the invention, which are, for the sake of clarity, described in the context of separate embodiments, may also be provided in combination in a single embodiment. Conversely, various features of the invention, which are, for brevity, described in the context of a single embodiment, may also be provided separately or in any suitable subcombination.

A modular system will now be described where the system is designed to provide for loading of a stent pre-mounted on a catheter into a coating chamber of a stent coating machine, for example, the one described in Shekalim '547 above The modular system provided to hold the pre-mounted stent and delivery system can be implemented as one that is reusable, i.e., it can be sterilized for re-use, or disposable, i.e., only meant to be used once. It is envisioned that the disposable system will maintain its sterility throughout any loading, coating and removing of the pre-mounted stent assembly from the coating system. The modular system is designed to accept sterile catheters and stent systems which may be available from different manufacturers.

The device is designed to function as an interface between a stent pre-mounted on a catheter and the coating application system. The device provides for locating the pre-mounted stent substantially in the center of rotation of the coating applicator where the stent is mounted substantially co-axial to the rotational axis of the system. The device allows for accurate and repeatable rotation of the stent and catheter around the rotational axis. The geometry of the device allows for repeatable mounting with reference to the machine's rotational axis for different stents mounted on different catheters. The device also allows for the coating apparatus to perform its necessary operations, for example, imaging of stent features and coating the device by, for example, a drop on demand jet applicator. The device also avoids damaging the stent and catheter during any loading, unloading and coating processes while maintaining the catheter system's sterility in an aseptic environment.

One of the issues addressed by the present invention is with respect to the accommodations for the long sheaths or lumens associated with stent delivery catheters or systems. These sheaths can range in length anywhere from 170-320 cm and are usually comprised of a flexible tube with a handle at a proximal end along with other access ports or connectors. The full length of a stent catheter system, from the stent at the distal end to the handle at the proximal end, may be about 1 meter in length. In some known catheter systems, the flexible tube at the distal end may be about 30 cm. In many instances, the balloon mounted catheter arrives from the manufacturer in a hoop that serves to protect the balloon-mounted stent and catheter as well as maintain its sterility.

Figure 2:
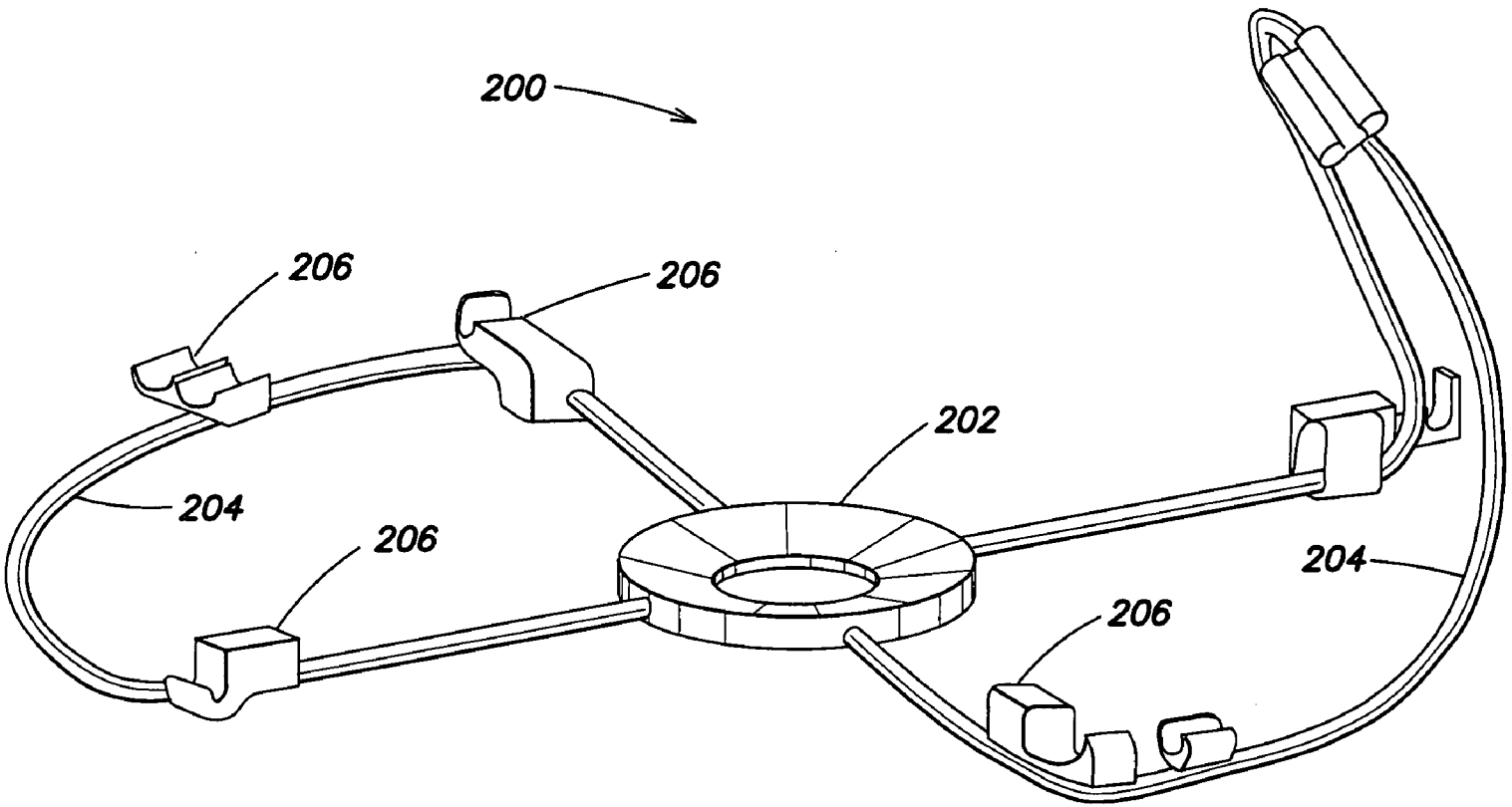
FIG. 2 is a schematic drawing of a plate for holding a catheter.
Figure 3:
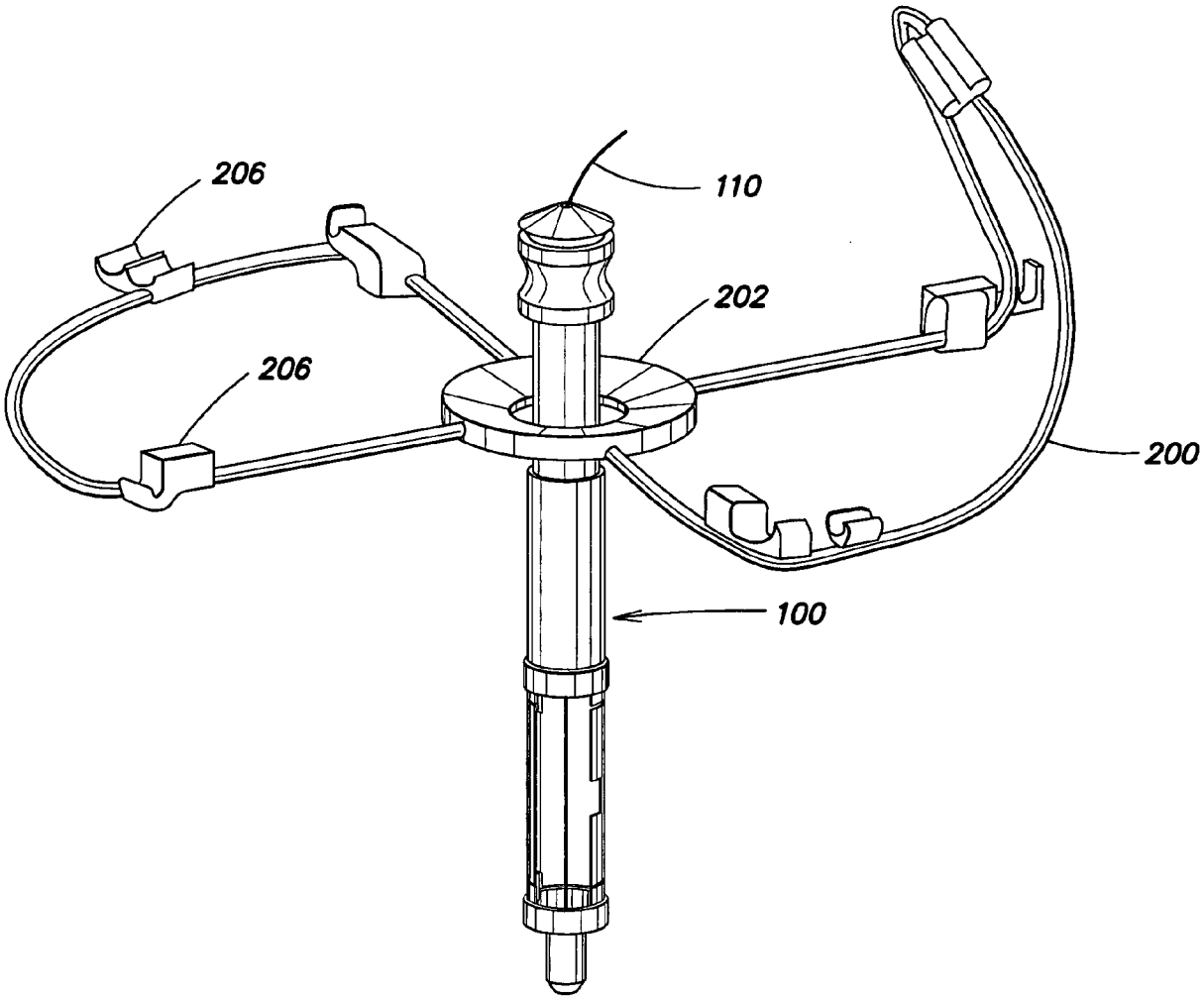
FIG. 3 is a schematic drawing of a system including the device of FIG. 1 and the plate of FIG. 2 in accordance with one embodiment of the present invention.

With reference to FIGS. 1-3, the modular stabilization system includes a stabilizing device 100 and a plate 200. The stabilizing device 100 comprises a substantially cylindrically-shaped and hollow tube that includes a proximal end 2 and a distal end 4. A top bushing 102 is located at the distal end 4. A cover 106 is disposed between the top bushing 102 and a bottom bushing 104. The cover 106 is removeably coupled between the top bushing 102 and a bottom bushing 104 and will be discussed below in more detail. A lock knob 108 and a cap 109 are disposed at the proximal end 2 of the housing of the stabilizing device 100. The lock knob 108 functions to lock and unlock a catheter from the top bushing 102 and will be described below in more detail. A guidewire 110 is provided within the stabilizing device 100 as either a permanent part or a removable part and is connected at one end to the bottom bushing 104 while a free end of the guidewire 110 remains outside of the stabilizing device 100 after passing through the cap 109. As shown in FIG. 1, the guidewire 110 is introduced through the cap 109 into and through the stabilizing device 100 to the bottom bushing 104. It should be noted that "top" and "bottom" with respect to the bushings 102 and 104, respectively, serve only as descriptive labels to distinguish the bushings and their use is not intended to limit any embodiment to a particular orientation unless expressly recited in a claim appended to this application.

A plate 200, as shown in FIG. 2, includes a central hub 202 to which a plurality of radial support arms 204 are connected. As shown in FIG. 2, the radial support arms 204, extend from the hub 202 and, as will be described below, have a shape to accommodate a catheter within its hoop. A number of hoop guides 206 are disposed at various locations on the radial support arms 204. The number and locations of the hoop guides 206 may have varied to accommodate catheters of various lengths or diameters. Further, the hoop guides 206 can be made from molded plastic and may be variably positionable on the radial support arm 204, or may be fixed in location. The hoop guides 206 may be configured to accept the hoop or catheter by friction fit of the hoop within a guide 206 or the guide 206 may have an active connector such as a clip or strap to hold the catheter. The hub 202 is sized to receive the stabilizing device 100 as shown in FIG. 3. In one embodiment, the plate 200 and the stabilizing device 100 are separate from each other while, in another embodiment, the stabilizing device 100 and the plate 200 are removably connected to one another.

Figure 4:
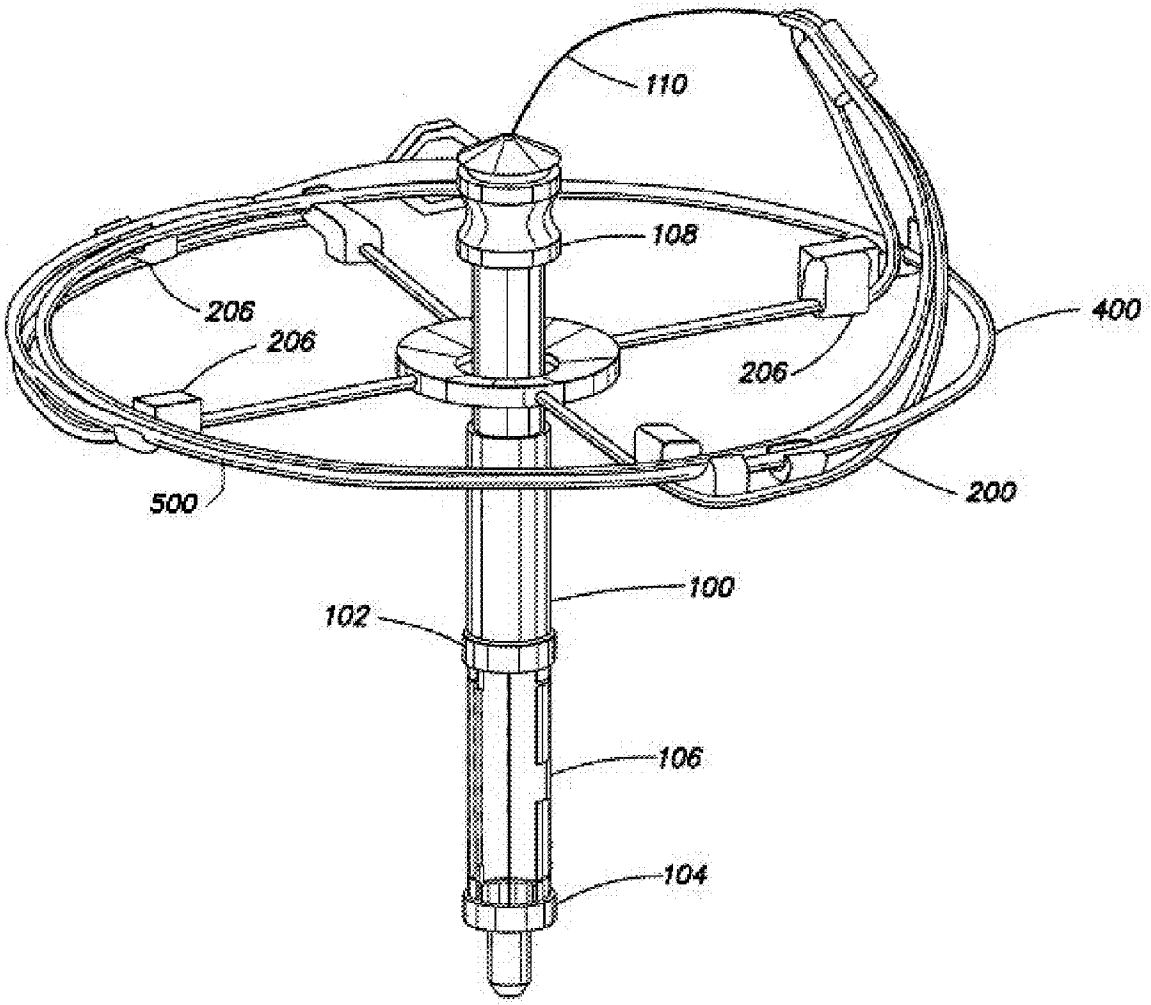
FIG. 4 is a schematic drawing of the system of FIG. 3 with a catheter mounted on the plate of FIG. 2.

In operation, a catheter 500 or delivery system, either in its hoop 400 or removed from the hoop, is mounted to the plate 200 by operation of, or coupling to, one or more of the hoop guides 206, as shown in FIG. 4. A distal end of the catheter, i.e., the portion at which the balloon-mounted stent is located, is inserted over the guidewire 110 into the stabilizing device 100. The end of the catheter is inserted by an operator until it is positioned in the distal most portion of the stabilizing device 100, i.e., the bottom bushing 104.

Figure 5A:
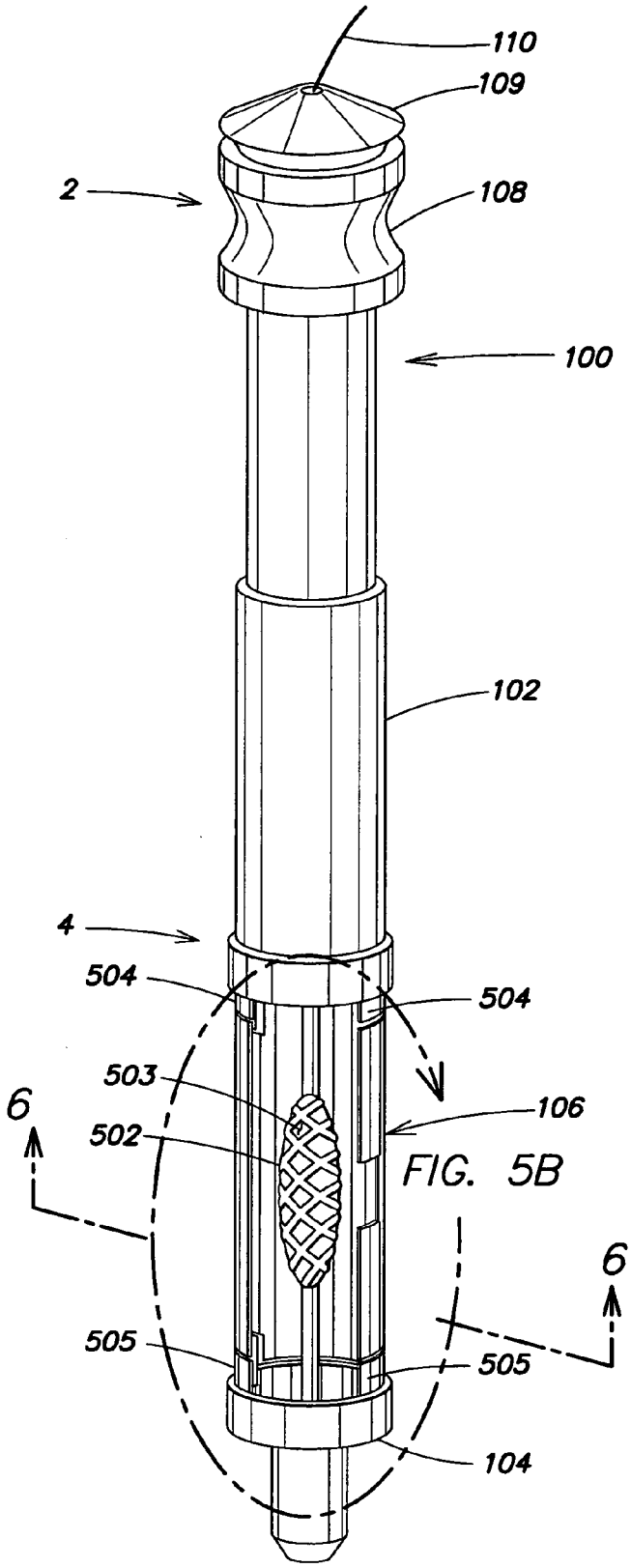
FIG. 5A is a perspective view of the device shown in FIG. 1.

As shown in FIG. 5A, a stent 502 mounted on a balloon catheter 503 is positioned within the device 100 by following along the guidewire 110. It should be noted that the stent 502 and balloon catheter 503 are presented schematically and without detail in the figures for clarity purposes.

The assembly, consisting of the catheter inserted into the stabilizing device 100 and mounted onto the plate 200, is inserted into a coating machine configured to receive the stabilizing device 100. The stabilizing device 100, the top bushing 102, and the bottom bushing 104 are rotated by the coating machine, i.e., synchronized, such that the stent, catheter and the plate 200 are driven as one rigid body. Contact between the stabilizing device 100 and the coating applicator is made between the top bushing 102 and the bottom bushing 104. Where the plate 200 and the device 100 are separate from one another, the coating apparatus is configured to capture each of the device 100 and the plate 200 to rotate them synchronously with one another.

Figure 5B:
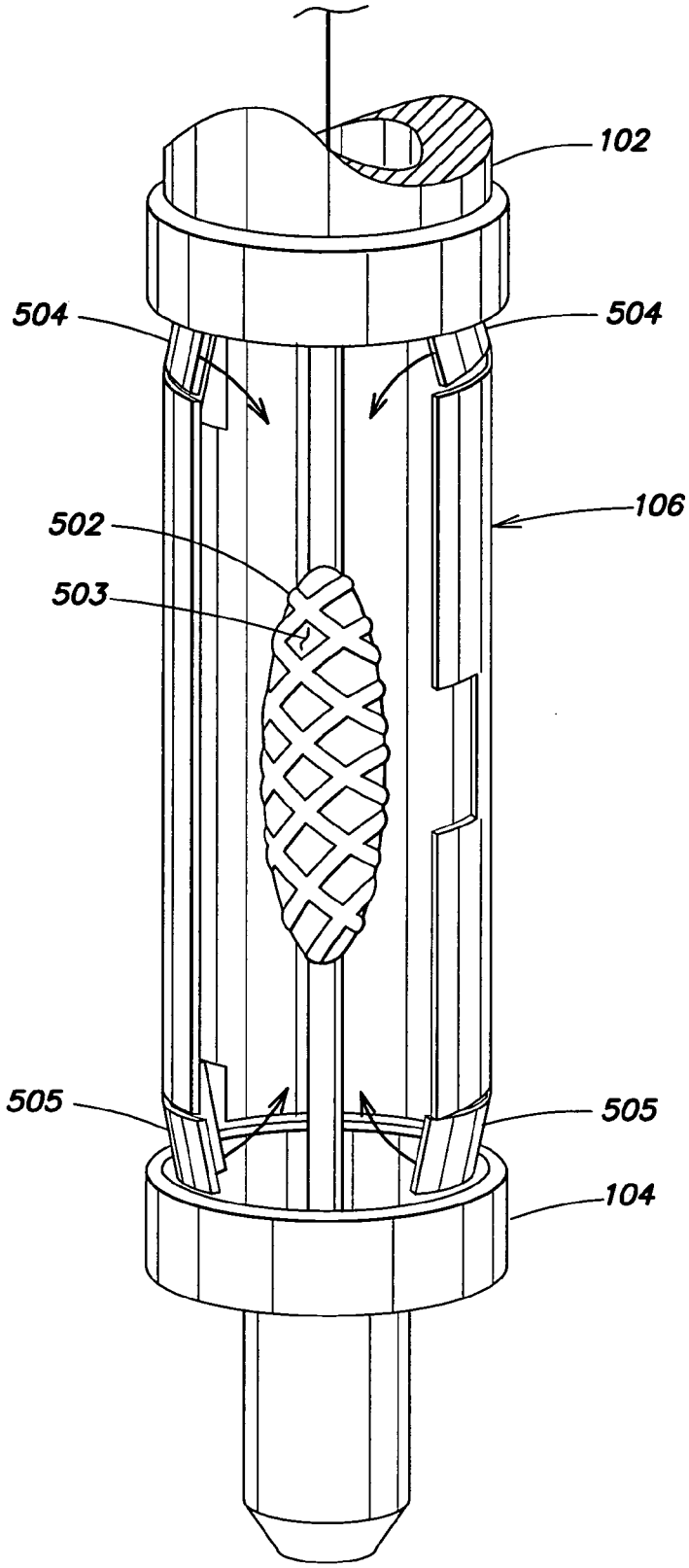
FIG. 5B is an expanded view of a portion of the device shown in FIG. 5A where the cover is decoupled from the device in accordance with one embodiment of the present invention.

As shown in FIGS. 5A and 5B, the cover 106 couples the top bushing 102 to the bottom bushing 104. The cover 106 comprises top spring flaps 504 that couple to the top bushing 102 and bottom spring flaps 505 that couple to the bottom bushing 104. The top and bottom spring flaps 504, 505 are biased to exert a force against an inner diameter surface of the top bushing 102 and an inner diameter surface of the bottom bushing 104, respectively. The top and bottom spring flaps 504, 505 may be integrally formed in the cover 106 and configured to provide the bias. One of ordinary skill in the art will understand that there are other mechanisms by which the bias can be imparted to the top and bottom spring flaps 504, 505 including, but not limited to, the use of a movable hinge with a coiled spring. Further, one or more grooves could be provided in either or both of the top and bottom bushings 102, 104 to receive the respective spring flaps 504, 505. The grooves can either extend substantially all the way around the circumference of a respective bushing or partially around. The placement of the grooves may also serve as a keying function to assure the device 100 is properly inserted in the coating machine.

Once the device 100 is placed in the coating machine, and prior to commencement of the coating operation, the cover 106 is decoupled from each of the top bushing 102 and the bottom bushing 104. An actuator in the coating machine, not shown, urges each of the top and bottom spring flaps 504, 505 inwardly, i.e., toward the inner axis of the device 100, to decouple the cover 106. The cover 106 is held in place such that the device 100, including the top bushing 102, the bottom bushing 104 and a stent 502, can be rotated while the cover 106 remains stationary.

Figure 6:
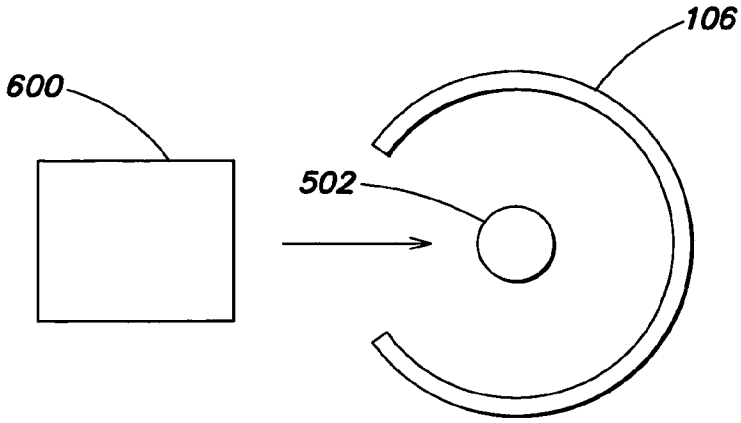
FIG. 6 is a cross-sectional view taken along line 6-6 in FIG. 5B.

When viewed along the line 6-6 in FIG. 5A, the cover 106, in one embodiment, remains stationary opposite an applicator 600 as shown in FIG. 6. The positioning of the cover 106 opposite the applicator 600, for example, an inkjet applicator, functions to provide a contained environment that operates as a small coating chamber. The cover 106 is configured as an open "C" shape, as shown in FIG. 6, in that the cover 106 does not extend circumferentially all the way around the device 100. The open portion operates to provide the coating chamber, or backdrop function, for the coating machine in addition to allowing access for image capturing to aid in positioning and coating application.

Figure 7:
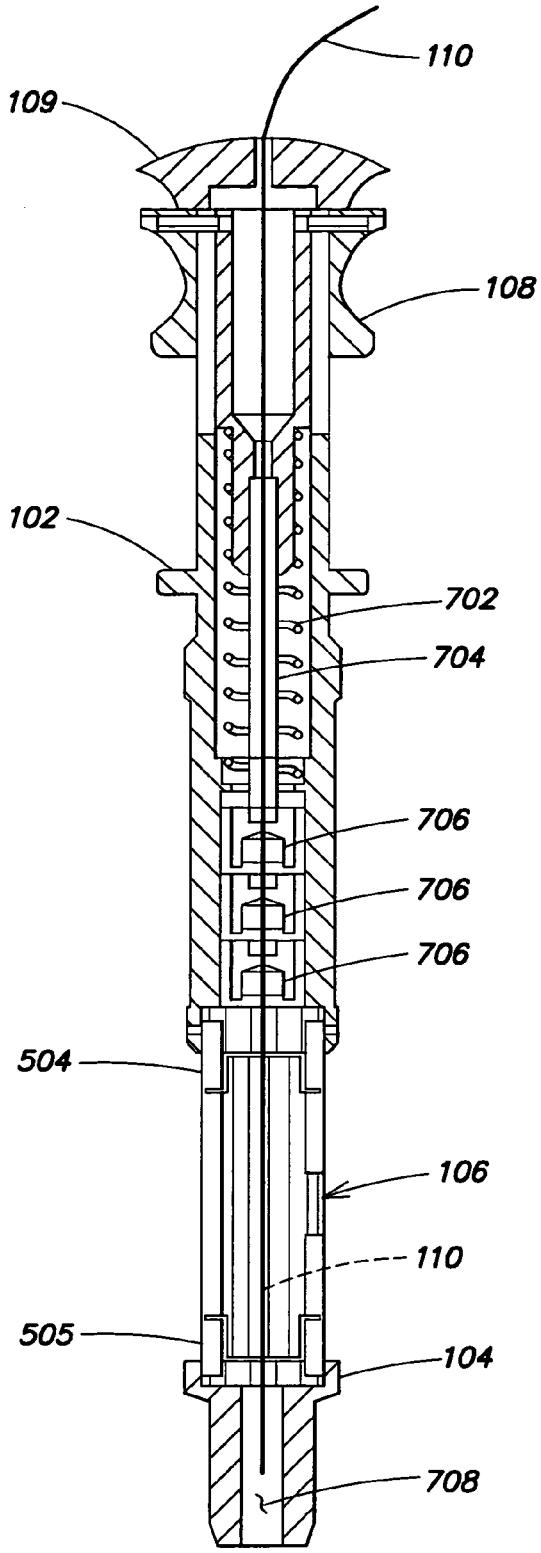
FIG. 7 is a partial cut-away view of the device of FIG. 1.

As shown in FIG. 7, the lock knob 108 is disposed about a proximal end of the stabilizing device 100. The lock knob 108 is urged to stay at the proximal end by a lock return spring 702 disposed within the stabilizing device 100. The lock knob 108 is also coupled to a guide pipe 704 through which the guidewire 110 passes. A plurality of locking guides 706 are also provided within the stabilizing device 100 and the guidewire 110 also passes through the locking guides 706. The guidewire 110 is connected at its distal end to a guidewire terminator 708 located in the bottom bushing 104.

The locking guides 706 are configured in size to fit within the internal diameter of the top bushing 102 and have a centerhole or clearance with an internal diameter sized to apply sufficient gripping force to a catheter shaft that has been positioned over the guidewire 110 and through the locking guides 706. This pressure provides for the coupling of the catheter to the top bushing 102. Further, the locking guides 706 are sized so as not to apply any substantial axial force to the catheter shaft that might cause damage but still maintain it held in place. The guide pipe 704 has an inner diameter sufficient to allow a balloon-mounted stent and catheter to pass through without binding or catching.

Figure 8B:
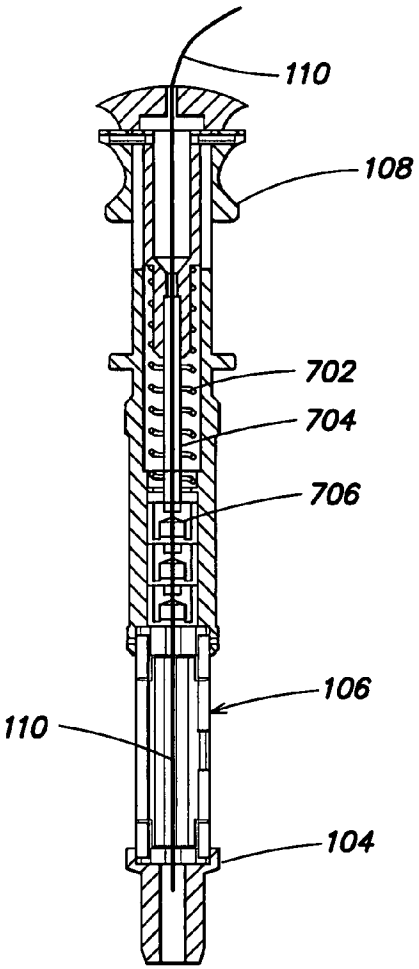
FIGS. 8A and 8B are partial cut-away views of the device in an open and closed configuration, respectively, according to an embodiment of the present invention.
Figure 8A:
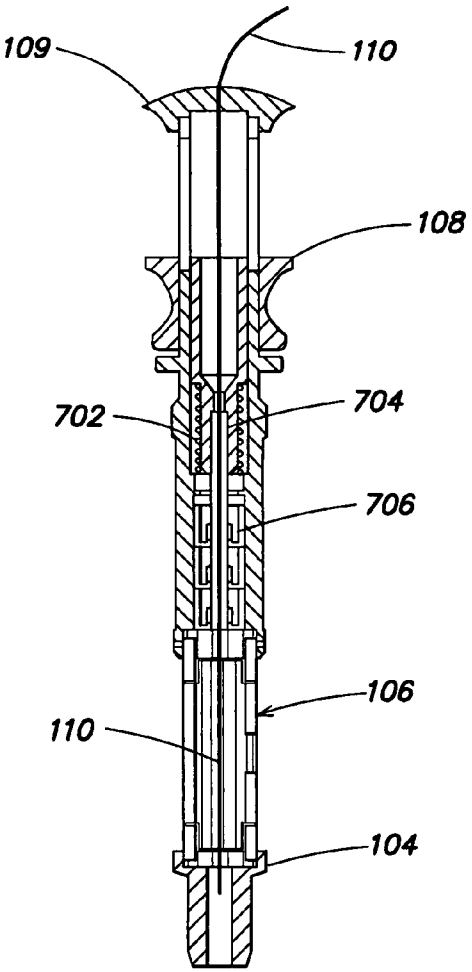

In operation, referring to FIGS. 8A and 8B, when the lock knob 108 is pushed down, i.e., away from the proximal end and toward the top bushing 102, the guide pipe 704 is urged into the small hole or clearance within the locking guides 706 and temporarily enlarges the diameter by deflection or compression depending on the material and shape of the locking guides 706. The internal diameter of the guide pipe 704 allows for the safe entry of the catheter system through the locking guides 706. Once the catheter has been passed down to the bottom bushing 104, the guide pipe 704 is retracted by moving the lock knob 108 toward the proximal end of the stabilizing device 100. As the guide pipe 704 is removed from the locking guides 706, the locking guides 706 recoil to embrace or capture the catheter shaft and apply a pre-determined radial force so as to immobilize the catheter with respect to the top bushing 102. One of ordinary skill in the art will understand that the force exerted on the catheter by the locking guides 706 is a function of the dimensions, geometry, and the properties of the material from which the locking guide 706 is made. The locking guides 706 can be made out of silicone, a fluorocarbon rubber material such as Viton® available from E.I. dupont de Nemours Company, or any other material having "rubber-like" characteristics that allow for resilient displacement. The guide pipe 704 may be made out of stainless steel or appropriate plastics material.

Figure 9:
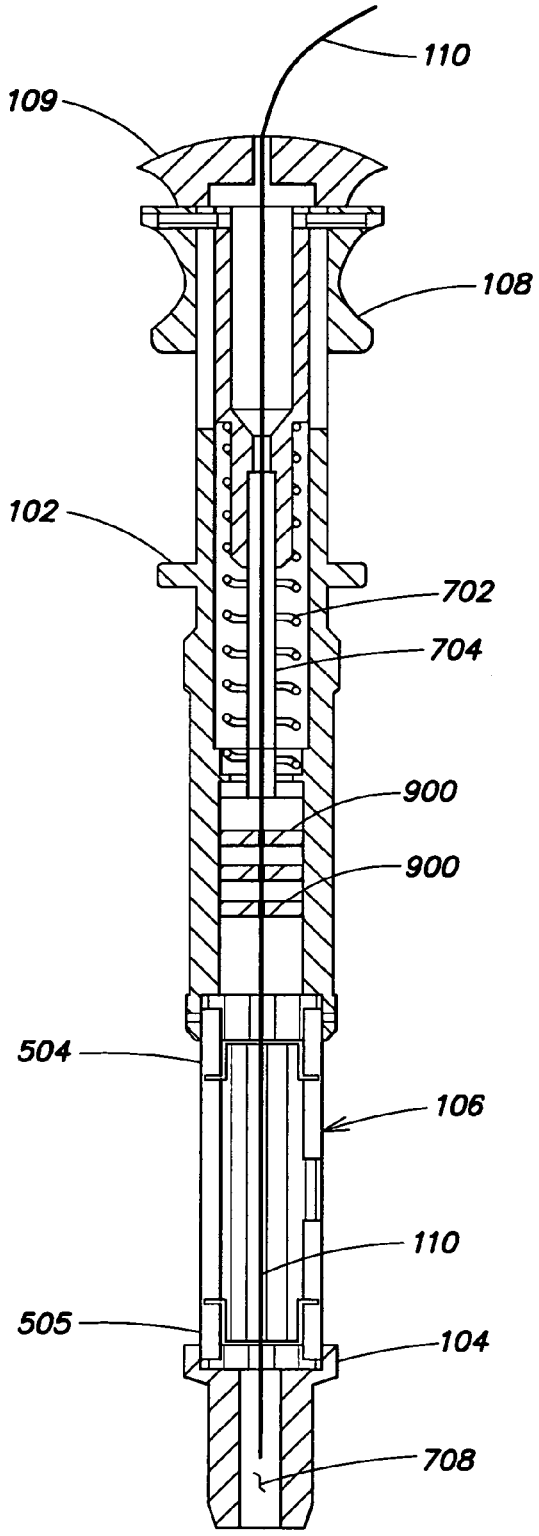
FIG. 9 is another embodiment of the device in accordance with one embodiment of the present invention.

While the exemplary embodiment shown depicts a plurality of locking guides 706, one of ordinary skill in the art will understand that a single locking guide 706 having sufficient longitudinal length so as to effectively grab and hold the catheter could also be used without deviating from the teachings of the present invention. Still further, a plurality of resiliently displaceable fingers 900 extending radially inward from the interior wall of the device 100, as shown in FIG. 9, are also envisioned as functioning in place of, or in addition to, the locking guides 706. These fingers 900 would normally be urged to capture the catheter 500 that is inserted in the device 100 and are displaced by the guide pipe 704 upon insertion. After the guide pipe 704 is removed, the fingers 900 would return to capture the catheter 500. The fingers 900 may be made from the same materials as the locking guides 706.

The stabilizing device 100 and plate 200 can be made out of material such as stainless steel to facilitate autoclaving for re-sterilization or may be made out of moldable plastics that can be sterilized once and then disposed of after a single use.

The foregoing exemplary description was with respect to a pre-mounted stent, i.e., a stent mounted on a balloon of a balloon delivery catheter, to be coated. In an alternative embodiment, the stabilizing device 100 may be used to coat a stent 502 that is not pre-mounted on a catheter. Of course, in such a system, the plate 200 is not necessary as there is no catheter delivery system.

Figure 10:
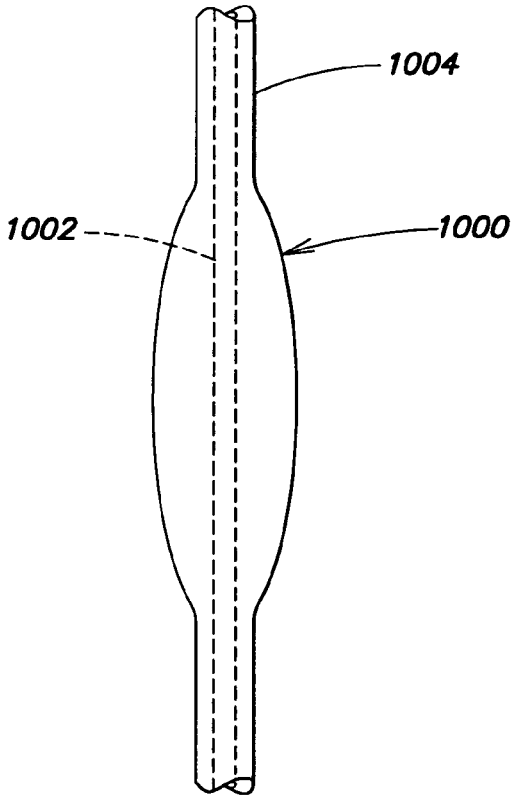
FIG. 10 is a mandrel for holding a stent according to one embodiment of the present invention.

A mandrel 1000, as shown in FIG. 10, is provided on which the stent 502 to be coated is mounted. The mandrel 1000 will be sized to hold the stent without causing deformation and such that there is no motion between the stent 502 and the mandrel 1000, i.e., they are fixed in position with respect to one another. In one embodiment, the mandrel 1000 will have a guidewire lumen 1002 passing through its longitudinal axis as well as a tail 1004, e.g., a stainless steel wire, to facilitate the insertion of the mandrel-stent assembly over the guidewire 110 and down to the bottom bushing 104. Alternatively, the mandrel 1000 can be configured without a guidewire lumen for insertion into a device 100 that does not include a guidewire 110. The guidewire 110 is not necessary if the mandrel 1000 is long enough to allow for insertion into the bottom bushing 104. As described above, the lock knob 108 will be operated so as to displace the locking guide 706, and once in place, as the guidewire 704 is withdrawn, the locking guide 706 will grab the tail 1004 and maintain the mandrel-stent assembly in fixed relation to the top bushing 102.

In one embodiment, the steps of applying the coating are: the adapter 100 is placed into the coating apparatus; the hoop is located on the plate 200; the lock knob 108 is moved to place the device 100 in the opened position; the catheter is fed over the guidewire 110 and fed down until stopped at the bottom bushing 104; the lock knob 108 is pulled up into the closed position thereby locking the device 100 to the catheter; the stent is coated; the lock knob 108 is pushed down; the catheter is removed from the adapter 110; the hoop with catheter is removed from the plate 200 and the adaptor 100 is removed from the coating machine.

The device 100 is keyed such that the orientation with the coating apparatus is assured. Contact between the coating apparatus and the device is made at the top bushing 102 and the bottom bushing 104. In one embodiment, contact is made by spring loaded bearing ball in the coating apparatus that fit into a groove in the device 100, i.e., by operation of gripping and friction. In another embodiment, the device 100, at either or both of the top 102 and bottom 104 bushings, may include the bearing ball and the coating apparatus includes the receiving grooves.

One of ordinary skill in the art will understand that there are other mechanisms by which such connection between the device 100 and the coating applicator could occur. In one alternative, the device 100 may be magnetically coupled, for example, by a controllable electromagnetic, to the coating apparatus. Further, gearing may be provided on the bushing portions to interact with gears in the coating apparatus through which rotational control may be imparted. Other mechanisms included, but are not limited to, operation of retractable pins that are controlled by the coating applicator and which couple with receiving ports located, for example, at the top 102 and bottom 104 bushings.

Once the device 100 is inserted in the coating apparatus, the functions of the coating applicator can then be implemented. These functions include, for example, visually scanning, rotating the assembly to access all portions of the stent to be coated, moving the coating applicator along the axis of the stent, and the like.

Alternatively, the catheter may be fed into the device 100 while the device is outside of the coating applicator, the hoop mounted on the plate 200, if necessary, and the device 100 then placed in the coating apparatus.

When the coating process is completed, the cover 106 is returned in place between the top bushing 102 and the bottom bushing 104 by the coating applicator.

While the device 100, in one embodiment of the present invention, is described as being cylindrical portions of the housing could be of other geometries, for example, rectangular or oval.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the invention. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A device, comprising:

a substantially cylindrical housing having a longitudinal length and having proximal and distal ends;

a first bushing coupled to the distal end of the housing;

a guidewire partially inserted through the housing, the guidewire having a proximal end and a distal end, wherein the proximal end of the guidewire remains free and is not located within the housing;

a second bushing attached to the distal end of the guidewire;

a knob slideably disposed about the proximal end of the housing and configured to slide a predetermined distance along an outer surface of the housing;

a guide pipe, coupled to the knob, and disposed within the housing, wherein the guidewire passes through the guide pipe; and a locking guide disposed within the housing and having an opening through which the guidewire passes, wherein the guide pipe extends through the locking guide when the knob is moved toward the distal end of the housing.

2. The device of claim 1, wherein the locking guide comprises:

a plurality of guide portions sized to fit within the housing; and each guide portion having an opening sized to receive and hold a catheter portion, wherein each guide portion comprises a material having resilient properties.

3. The device of claim 1, wherein:

the opening in the locking guide expands from a first diameter to a second diameter by operation of the guide pipe when the knob is moved toward the distal end of the housing and returns to substantially the first diameter when the knob is returned to the proximal end of the housing and the guide pipe is withdrawn from the opening of the locking guide.

4. The device of claim 1, wherein the locking guide comprises:

a plurality of resilient fingers extending inwardly from an inner wall of the housing.

5. The device of claim 4, wherein:

the plurality of resilient fingers are arranged in opposing pairs, and spaced apart, to define the opening through which the guidewire passes.

6. A system for positioning a prosthesis in a coating apparatus, the system comprising:

a stabilizing device configured to hold the prosthesis in a defined orientation with respect to the coating apparatus, the stabilizing device comprising:

a substantially hollow housing having a longitudinal length extending between a proximal end and a distal end;

a first coupling mechanism disposed at the distal end of the housing;

a second coupling mechanism;

a removable cover, having proximal and distal ends, coupled, respectively, to the first and second coupling mechanisms; and a guidewire, having a proximal end and a distal end, positioned within the housing, wherein the distal end of the guidewire is attached to the second coupling mechanism;

a guide pipe disposed within the housing;

a knob, coupled to the guide pipe, and slideably disposed about the proximal end of the housing; and a resilient guide disposed within the housing, the resilient guide having an opening through which the guidewire passes, wherein the guide pipe extends through the resilient guide when the knob is moved toward the distal end of the housing, and wherein the guidewire passes through the guide pipe.

7. A stabilizing device, comprising:

a substantially cylindrical housing having a longitudinal length and having proximal and distal ends and a guidewire lumen extending therethrough;

a first bushing disposed at the distal end of the housing;

a guidewire positioned within the guidewire lumen, the guidewire having a proximal end and a distal end;

a second bushing attached to the distal end of the guidewire;

a guide pipe disposed within the housing and within the guidewire lumen, wherein the guidewire passes through the guide pipe;

a knob, coupled to the guide pipe, and slideably disposed about the proximal end of the housing and configured to slide a predetermined distance along an outer surface of the housing; and a resilient guide disposed within the housing substantially at the distal end thereof, the resilient guide having an opening through which the guidewire passes, wherein the guide pipe extends through the resilient guide when the knob is moved toward the distal end of the housing.

8. The device of claim 7, wherein the resilient guide comprises:

a plurality of cylindrical resilient guides sized to fit within the housing; and each cylindrical resilient guide having an opening sized to receive and hold a catheter portion.

9. The device of claim 8, wherein:

each opening in a respective cylindrical resilient guide expands from a first diameter to a second diameter by operation of the guide pipe when the knob is moved toward the distal end of the housing and returns to substantially the first diameter when the knob is returned to the proximal end of the housing and the guide pipe withdrawn from within the cylindrical resilient guide.

10. The device of claim 7, wherein the resilient guide comprises:

a plurality of resilient fingers extending from an inner wall of the housing.

11. The device of claim 10, wherein:

the plurality of resilient fingers are arranged in opposing pairs, and spaced apart, to capture a catheter therebetween.

* * * * *